US008299879B2

(12) United States Patent
Casper et al.

(10) Patent No.: US 8,299,879 B2
(45) Date of Patent: Oct. 30, 2012

(54) TRANSFORMER ASSEMBLY USING AN INTERNAL LOAD AND METHOD FOR FORMING SAME

(75) Inventors: Ted Casper, West Bend, WI (US); Gordon Ford, St. Joseph, MI (US); Brad Rush, St. Joseph, MI (US)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 13/024,686

(22) Filed: Feb. 10, 2011

(65) Prior Publication Data

US 2012/0206229 A1 Aug. 16, 2012

(51) Int. Cl.

| | |
|---|---|
| ***H01F 27/02*** | (2006.01) |
| ***H01F 27/28*** | (2006.01) |
| ***H01F 7/06*** | (2006.01) |
| ***H05B 37/00*** | (2006.01) |
| ***H05B 41/14*** | (2006.01) |
| ***H01J 7/44*** | (2006.01) |

(52) U.S. Cl. ..... 336/82; 336/229; 29/606; 315/177; 315/243; 315/70

(58) Field of Classification Search ..... 336/90, 336/82, 92, 229, 223; 29/606; 315/276, 315/177, 243, 70, 248

See application file for complete search history.

(56) References Cited

U.S. PATENT DOCUMENTS

| | | | | |
|---|---|---|---|---|
| 2,455,875 | A | 12/1948 | Peterson et al. | |
| 2,469,162 | A | 5/1949 | Gehman et al. | |
| 3,146,351 | A * | 8/1964 | Adams et al. | 376/111 |
| 3,162,829 | A | 12/1964 | Wildy et al. | |
| 3,436,709 | A | 4/1969 | Schapira et al. | |
| 3,480,896 | A | 11/1969 | Neuman | |
| 3,500,274 | A | 3/1970 | Matsuura et al. | |
| 3,629,759 | A * | 12/1971 | Douglas et al. | 336/82 |
| 4,837,544 | A * | 6/1989 | McDougal | 336/185 |
| 5,214,403 | A | 5/1993 | Bogaerts et al. | |
| 6,084,354 | A * | 7/2000 | Kohmura et al. | 315/57 |
| 6,173,611 | B1 * | 1/2001 | Laughlin | 73/504.05 |
| 6,194,834 | B1 * | 2/2001 | Seiler et al. | 315/82 |
| 6,680,575 | B1 * | 1/2004 | Ushio et al. | 315/77 |
| 6,731,076 | B1 * | 5/2004 | Gerhard et al. | 315/289 |
| 7,772,780 | B2 * | 8/2010 | Pokharna et al. | 315/56 |
| 2003/0175156 | A1 * | 9/2003 | Ford | 422/63 |
| 2008/0157696 | A1 * | 7/2008 | Pokharna et al. | 315/276 |
| 2008/0204180 | A1 * | 8/2008 | Aboumrad et al. | 336/92 |

FOREIGN PATENT DOCUMENTS

| | | | |
|---|---|---|---|
| JP | 55-125610 A | * | 9/1980 |
| JP | 55-125610 A | * | 9/1980 |

* cited by examiner

*Primary Examiner* — Mohamad Musleh
*Assistant Examiner* — Mangtin Lian
(74) *Attorney, Agent, or Firm* — Price Heneveld LLP

(57) ABSTRACT

A transformer assembly (300) for use with an internal load (307) includes a transformer core (323) having a primary winding (405). A first electrode (303) and second electrode (319) are used for contacting an internal load (307). A secondary circuit is formed that includes the first electrode (303), the second electrode (319) and conductors (301,313, 317) positioned between the first electrode (303) and second electrode (319). The transformer assembly (300) is arranged so that the conductors (301, 313, 317) surround the primary winding (405), transformer core (323), the first electrode (301) and second electrode (319). The transformer assembly (300) may be used in an electrode furnace or other high current and voltage applications requiring high efficiency in a small package.

60 Claims, 4 Drawing Sheets

TRANSFORMER ASSEMBLY USING AN INTERNAL LOAD AND METHOD FOR FORMING SAME

FIELD OF THE INVENTION

The present invention generally relates to power supplies and more particularly to a power supply containing a transformer using an internal load.

BACKGROUND OF THE INVENTION

In a particular application of this invention, an electrode furnace (EF) enables rapid heating of a sample material used to create gases. These gases are then analyzed for their composition using a variety of scientific methods. The EF operates by generating a high current which is passed through a conductive crucible. Current is conducted through the crucible using electrode contacts. The current heats the crucible and any sample material therein. As used herein, the term electrode defines an electromechanical connection between a conductive material and a load.

Prior art systems have used large mains-frequency (50 Hz-60 Hz) power supplies to generate the high currents necessary to rapidly produce enough heat to drive off gases in the sample material. These types of linear power supplies require a large iron core transformer making them bulky and difficult to integrate into the EF. Although higher frequency switching supplies can be used for reducing the transformer size, these types of switching supplies often have problems when delivering a high current to the load. This is primarily due to the stray inductance created by the flexible lead wire used to connect the transformer with the electrode, the electrode inductance, and the transformer leakage inductance. The stray inductance results in an impedance that increases with frequency and is in series with the crucible resistance. At normal mains input frequencies of 50 Hz-60 Hz, the stray inductance contributes an insignificant amount of inductive reactance to the system. Therefore, the transformer secondary circuit impedance is dominated by the crucible resistance at 50 Hz or 60 Hz. At frequencies normally utilized by switching power supplies, the inductive reactance created by the stray inductance can be many times that of the crucible resistance.

FIG. 1 is a block diagram illustrating a prior art EF system 100 using a phase chopper supply. As described herein, the EF system 100 is used for heating a crucible 109. A mains input voltage 101 is supplied to a conduction angle or phase controlled chopper 103 used to regulate the output current of a step down transformer 105. The chopper limits the input waveform to the transformer to less than one full cycle by use of an SCR or similar device. The transformer 105 works to supply a substantially high current through a flexible connection 107 to a crucible 109 used for holding analytical samples. The flexible connection 107 consists of the secondary circuit leads and the electrodes used to hold the crucible. Because the phase controlled chopper 103 only conducts during a portion of the mains input 101 alternating cycle, the phase controlled chopper 103 heavily loads the mains input voltage 101 by drawing large amounts of non-sinusoidal current. This often results in voltage disturbances to other devices connected to the same mains supply. Moreover, the non-sinusoidal current creates a poor power factor that increases the apparent power required to operate these devices.

A conventional EF utilizes 50 Hz-60 Hz power transformers and large copper conductive braided straps to create a mechanically flexible high current connection from the transformer to the electrodes. The flexible braids are required for allowing the electrodes to be separated for cleaning and inserting a new crucible for each analysis. The EF furnace uses a set of electrodes for delivering over 1100 Amps to a crucible. The magnetic loop created by the flexible leads connecting the transformer secondary to the electrodes produces substantial amounts of magnetic field that can couple into nearby objects. These magnetic fields can create interference with devices such as CRT monitors resulting in distortion of picture quality by altering the display position at the main frequency or one of its harmonics.

Often, the use of braid conductor at frequencies utilized by switching power supplies is not practical due to skin effect and large eddy currents resulting in extremely high temperatures in the connections. The high temperatures increase oxidation of the braid material further increasing its resistance. Moreover, the transformer's primary wires can also experience localized heating due to the large magnetic field created by the secondary current. In prior art devices, the high secondary current loop encircles only one side of the transformer creating magnetic fields that are not homogeneous over the entire structure. This often creates eddy current heating of the transformer's primary wires. The heated primary wire warms the transformer core. The added losses lower the amount of power the transformer can deliver before exceeding the transformer maximum operating temperature.

From a mechanical perspective, the size and weight of the 50 Hz-60 Hz transformer used in connection with thick copper braids result in increased package size and greater shipping cost. Although electronic solutions are known in the art for increasing the operating frequency to reduce transformer size, methods for reliably making such an electro-mechanical structure at the higher frequencies had not been realized. The problems involve realizing a flexible mechanical structure that minimizes inductance and loss of the high current secondary while providing reliable electrical contacts. The structure must allow repetitive insertion and removal of a crucible. Cleaning of the electrode assembly is also a requirement.

Alternative applications of using standard 50 Hz-60 Hz methods include using rigid bus bars and contacts to complete the electrical circuit. This includes using a conventional transformer high current secondary connected with conventional electrodes. This solution suffers from many of the problems outlined in previous paragraphs. Still further alternatives to the construction include the use of high current flexible conductors in the form of an S-bent conductive sheet. In this solution, the transformer is remote from the electrodes and the S-bent sheet is used to make the connections between the transformer secondary and the electrodes. A disadvantage to this type of arrangement includes excess inductance along with many problems as discussed previously.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION OF THE PREFERRED EMBODIMENTS

Figure 1:
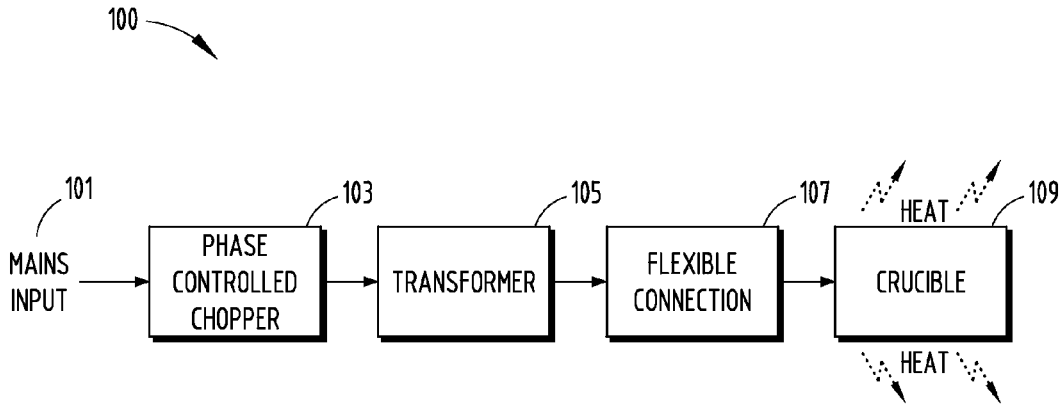
FIG. 1 (PRIOR ART)
FIG. 1 is a block diagram illustrating a prior art EF system using a phase chopper supply.

Before describing in detail embodiments that are in accordance with the present invention, it should be observed that the embodiments reside primarily in combinations of method steps and apparatus components related to a transformer using an internal load. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

The present invention provides a novel solution to a transformer's localized primary wire heating that involves encasing a transformer in a conductive housing or shield producing a more homogeneous magnetic field and providing the same magnetic coupling for each primary winding. The shield also serves as a portion of the secondary circuit eliminating the need for flexible secondary leads connected to the electrodes. The invention solves the inductance and loss issues of a conventionally mounted power transformer while providing a large surface area for a high current sliding contact. The size and weight of the total system is reduced while simplifying the design by combining the transformer secondary conductor with the conductive housing and the electrode assemblies. It also minimizes power losses to where mechanical structure efficiency is over 98% in view of the low resistance provided by the highly conductive materials used in its construction. Losses are further minimized by the short current path of the conductive housing.

Figure 2:
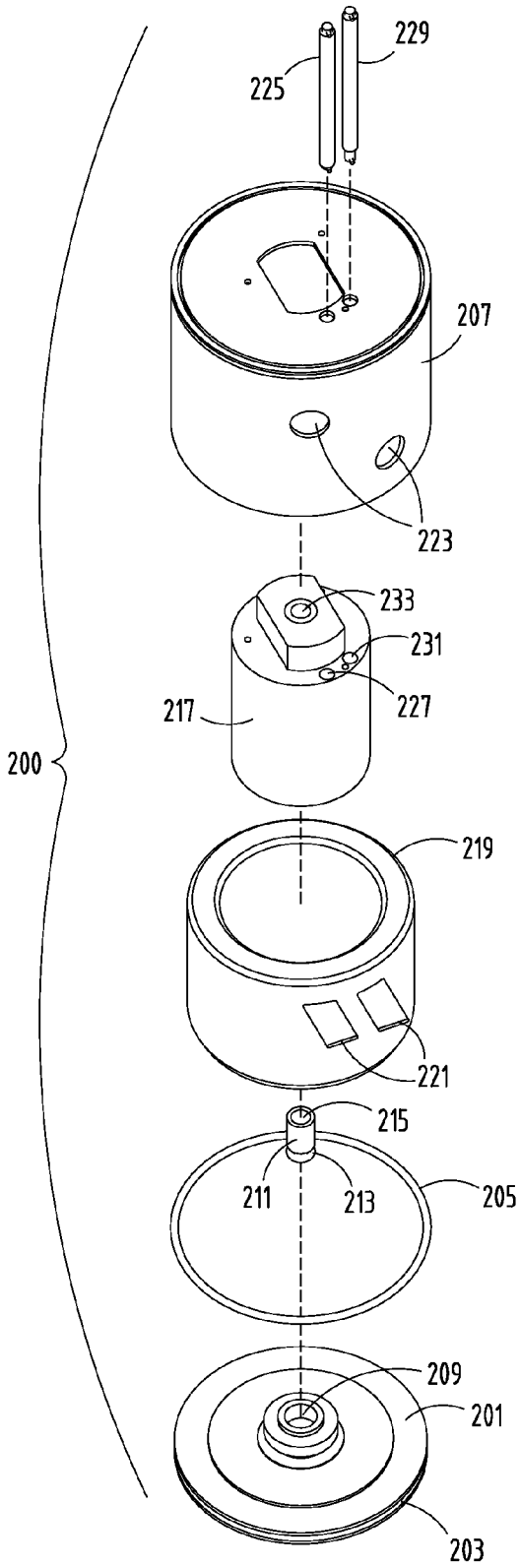
FIG. 2 is an exploded view of the transformer using an internal load according to an embodiment of the invention.

FIG. 2 is an exploded view of a transformer using an internal load used in connection with an electrode furnace according to an embodiment of the invention. As described herein, the electrode furnace assembly 200 is formed using both a first electrode and second electrode for creating an electrical circuit. When in use, a conductive crucible containing a sample material is positioned in an area between the first and second electrodes. The crucible can be made of any suitable electrically conductive material such as graphite or the like. The terms load and crucible have a similar meaning and are used interchangeably herein.

The crucible is in physical contact with the first electrode and second electrode allowing a substantially large amount of current to be applied through the crucible with minimal electrical losses in the electrode structure. This allows the crucible to be heated to very high temperatures in order to evolve and/or expel gases from a sample material contained therein. These gases can then escape from a port where they can be used for various types of testing and analysis. A conductor is also positioned between the first electrode and the second electrode forming a circular current path through the first electrode, the conductive crucible or load, the second electrode, the conductor and then returning to the first electrode forming an electrical circuit. This current path is positioned so it passes through a transformer core window creating a high current secondary circuit magnetically coupled to the transformer core and primary winding. As will be evident to those skilled in the art, the conductor may consist of a single or multiple conductors arranged to form a connection between the first electrode and second electrode.

As seen in FIG. 2, the transformer using an internal load 200 includes a first conductor 201 having a grooved channel or edge 203 for holding a flexible conductive brush contact 205. The brush contact 205 serves as a sliding high current contact when joined with the interior of the canister assembly 207. Those skilled in the art will recognize that the brush contact 205 can consist of different mechanical implementations including, but not limited to, wire fingers, wire mesh, or spiral wound springs using various types of electrically conductive materials. The brush contact 205 is used for making a low impedance electrical contact with the grooved edge 203 and the interior surface of canister assembly 207. In use, a first electrode 209, located at the interior of the first conductor 201, is in contact with the conductor 201. The first electrode 209 forms a contact point and/or surface with the bottom 213 of a crucible 211 for passing substantially high currents from the first conductor 201 to the crucible 211. The top 215 of crucible 211 contacts a second electrode (not shown) of a second conductor assembly 217 for passing substantially high currents between the second conductor assembly 217 and the crucible 211.

When assembled, the second conductor assembly 217 is arranged such that it passes through the center of transformer core assembly 219 and forms an electrical connection to the top of the canister assembly 207. The canister assembly 207 is multifunctional serving to provide a conductive housing or path for current to flow in the secondary circuit and as a shield to close or seal the electromagnetic structure of the design. The canister assembly is typically manufactured of a metallic material for providing shielding and electrical conductivity. All of the magnetic fields created by the secondary current flow are contained within the shielded structure of canister assembly 207, the first conductor 201 and the second conductor assembly 217 as will be described herein.

The interior of the canister assembly 207 contains a surface (not shown) for allowing insertion of the brush contact 205, which forms a high current contact. The closed circuit formed by the brush contact 205, first conductor 201, crucible 211, second conductor assembly 217, and canister assembly 207 form a single turn secondary winding coupled to transformer core assembly 219. The sliding brush contact 205 allows for movement and opening of first conductor 201. This facilitates the removal and installation of the crucible 211 for adding analytical materials inside the crucible 211 as well as any cleaning of the electrode surfaces of first conductor 201 and second conductor 217. The transformer core assembly 219 includes primary leads 221 that pass through apertures 223 in the canister assembly 207. The primary leads connect with an inverter or other power electronics (not shown). An inverter or power electronics are used for creating a predetermined excitation voltage required for driving the electrode furnace assembly 200.

The second electrode probe 225 passes through hole 227 in the second conductor assembly 217 and into an area of the second conductor assembly 217 near the electrode contact (not shown) made with crucible top 215. Similarly, the first electrode probe 229 passes through the second conductor assembly 217 by means of hole 231 for making an electrical connection on first conductor 201 near first electrode 209. The second electrode probe 225 and first electrode probe 229 provide an instrument for various load measurements and/or the voltage at the crucible 211. The second conductor assembly 217 further contains a port 233 for the collection of gases escaping from the crucible 211 and/or the samples contained therein (not shown). The port 233 passes through the second conductor assembly 217 to a region located above the crucible top 215. As will be evident to those skilled in the art, both the second conductor 217 and first conductor 201 can be cooled if necessary by conventional means such as, but not limited to, heat pipes, liquid, convection, forced air or any combination of these cooling techniques.

One advantage of the invention is the incorporation of the load or crucible into the transformer structure. This arrangement has the effect of eliminating the need for a secondary winding in the transformer assembly or other connections between the load and the secondary winding. Moreover, the invention provides easy installation and removal of the load through the use of a sliding contact formed using brush contact 205 and the interior (not shown) of the canister assembly 207. In use, the first conductor 201 and/or the second conductor assembly 217 can engage a sliding contact for allowing the first electrode 209 and/or second electrode (not shown) to adjust position in the canister assembly 217. This allows for a variety of different size loads to remain in contact with the first electrode 209 and the second electrode (not shown). Although the use of a brush contact 205 is described herein, other methods of creating a sliding or adjustable contact for allowing opening of the canister and/or changing load dimensions can also be used. The sliding or adjustable contact can include but is not limited to clamps, split rings, knife edge contacts, or screw assemblies. Use of alternative methods for achieving a mechanically flexible structure are also within the scope of the invention.

In the case of using the invention in EF applications, the load is the conductive crucible 211. Many difficulties can arise when creating systems for use with such high power. These difficulties include heat dissipation and electromagnetic field generation. The details as described herein illustrate a particular application of the invention with regard to an EF application. The descriptions as provided herein are not intended to limit the scope of this invention but are merely described with regard to a particular application. These descriptions serve to highlight the design solutions used in the present invention for creation of an EF application. Those skilled in the art will further recognize that other applications of the invention can include but are not limited to the heat treatment of materials, fluid heating, gas heating, and/or the melting and formation of various materials.

Figure 3:
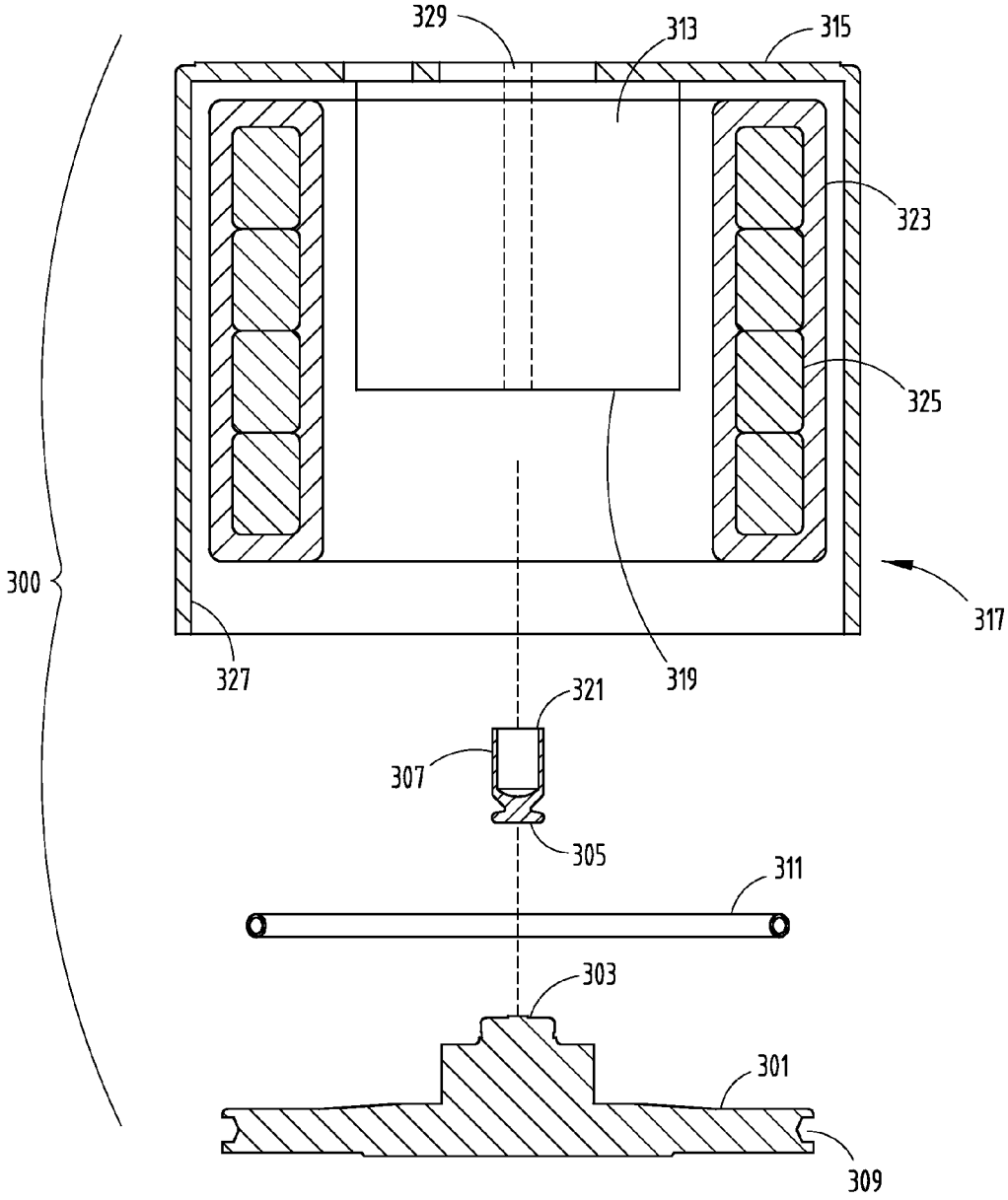
FIG. 3 is a cross-sectional view of the transformer using an internal load according to an embodiment of the invention.

FIG. 3 illustrates a cross-sectional view of a transformer using an internal load as seen in FIG. 2. The transformer using an internal load 300 is used in connection with an electrode furnace according to an embodiment of the invention. The first conductor 301 has a pedestal or first electrode 303 for making electrical contact with the bottom 305 of a load 307. The load 307 is a conductive crucible specifically for an EF application. The first conductor 301 includes a channel such as surface 309 for holding a flexible conducting brush contact 311. As described above, a second conductor 313 is attached to a top cover 315 of a canister assembly 317. The canister assembly 317 provides electrical contact with its mating components as described herein. In use, the canister assembly 317, along with first conductor 301, forms a conductive housing for the transformer core assembly. The first conductor 301, second conductor 313, cover 315 and canister assembly 317 can be constructed of any suitable conductive material. The second electrode 319 of second conductor 313 is used to make contact with a top 321 of the load 307.

The transformer core assembly 323 includes at least one core 325 that is made of ferrite or other magnetic materials that is inserted within the interior of the canister assembly 317. The transformer core assembly 323 is positioned so that the second conductor 313 passes through the window forming a magnetic transformer assembly or structure. The window of the magnetic structure is comprised of an area that a winding would pass through in order to couple magnetic energy between the core and the winding. The transformer core assembly 323 further contains a primary winding (not shown) with leads passing through the canister assembly 317 for connection to a power source (not shown). The inside surface 327 of canister assembly 317 is designed to accept the conducting brush contact 311 which forms a sliding electrical contact. When the first conductor 301 is inserted into the canister assembly 317, the load 307 forms an electrical current path between first conductor 301 and second conductor 313.

In addition, the brush contact 311 forms an electrical contact between the first conductor 301 and the canister assembly 317. The complete electrical current path of first conductor 301, load 307, second conductor 313, cover 315, canister assembly 317, and brush contact 311, which is in contact with both first conductor 301 and canister assembly 317, passes through the window of transformer core assembly 323. This provides a magnetic coupling to the primary winding (not shown). The load 307 is internal to the transformer structure and the brush contact 311 allows for easy opening and closing of the structure. This in-turn allows for the replacement of the load 307 after use as well as the cleaning of electrodes 303 and 319. The brush contact 311 also allows for different size loads to be installed in the assembly since brush contact 311 forms a sliding contact with canister assembly inside surface 327. Further, the sliding contact formed by brush contact 311 allows for expansion and contraction of load 307. When used in an EF application, second conductor 313 may include a channel 329 for collection of gases from the load 307. First conductor 301, canister assembly 317, and second conductor 313 could be manufactured from any suitable conductive material capable of passing substantially high currents with minimal power loss. The canister assembly 317 and first conductor 301 surround the load 307, second electrode 317, first electrode 303, transformer core assembly 323 and the primary winding (not shown). The canister assembly 317, second conductor 313 and first conductor 301 form a conductor positioned between the first electrode 303 and second electrode 319.

Figure 4:
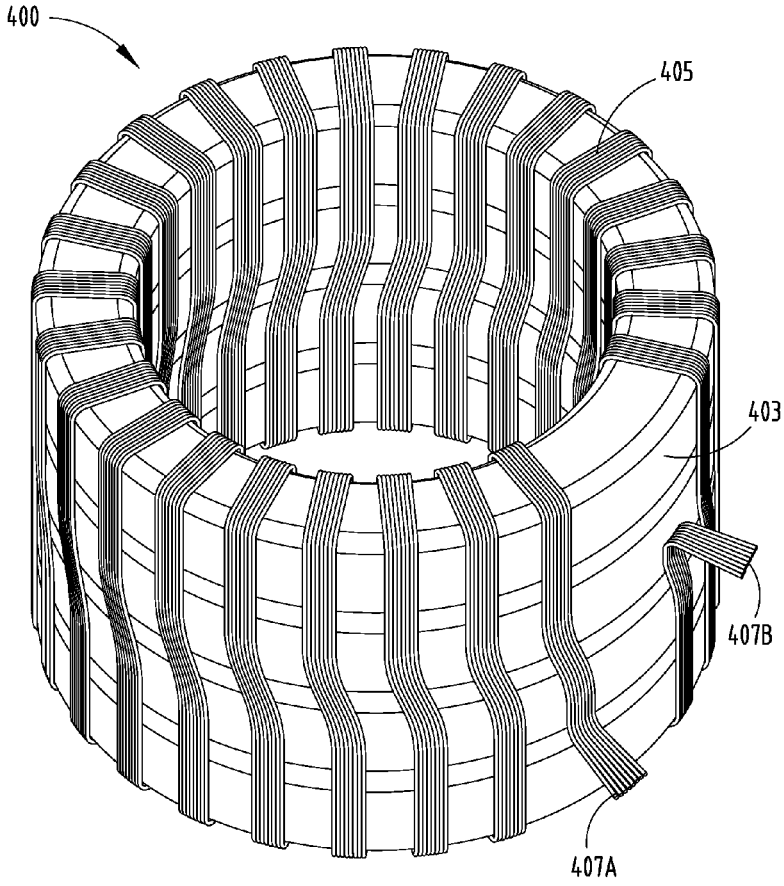
FIG. 4 is an isometric view of the transformer core and primary winding assembly according to an embodiment of the invention

FIG. 4 shows a transformer core assembly 400 as used in an embodiment of the present invention. The assembly includes a transformer core 403 that is constructed using commercially available ferrite cores having a toroidal or ring shape. For applications in an electrode furnace, the terms "ring" or "toroid" are used interchangeably when referring to the transformer core. Those skilled in the art will recognize that other magnetic shapes can be utilized such as square or rectangular forms. The geometric shape of the core should not be considered to limit the scope of this invention. In addition, other magnetic materials including, but not limited to, tape wound steel or powdered iron could also be used in the construction without deviating from the scope of the invention. For the EF application, a stack of one or more cores was selected to provide the desired magnetic field strength and meet the systems design and physical requirements. In use, the toroidal core 403 is covered with a suitable insulating covering of epoxy or tape (not shown) to protect the winding from shorting to the core. A primary winding 405 is applied over the insulation.

By way of example, for the EF application, twenty-four (24) turns forming the primary were utilized to achieve the desired magnetic operating point and turns ratio. Those skilled in the art will further recognize that a "turn" is counted when it passes through the window of the magnetic material. In the case of a toroid, the window is the center hole of the structure. Due to the large currents involved, the primary winding can consist of multiple parallel wires or conductive ribbon to increase the surface area and minimize losses. To create a uniform field and minimize leakage inductance, the primary windings are evenly distributed over the core surface in a single layer. The connection leads 407A, 407B are affixed to the primary windings for connection to the power electronics (not shown) providing the required voltage and current. In view of the structural nature of the invention as described herein, the transformer core assembly 400 does not have a wound secondary. However, the insertion of the second conductor assembly in the window of the transformer core along with the canister assembly, load and first conductor operate to create a single turn secondary with high current handling capabilities.

Figure 5:
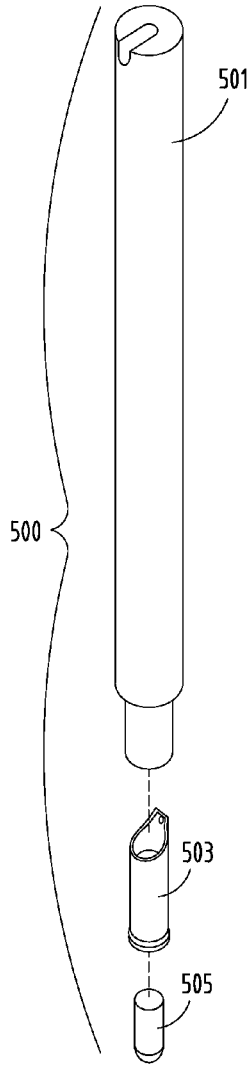
FIG. 5 is a exploded view of the voltage probe assembly according to an embodiment of the invention Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

FIG. 5 illustrates the probe assembly 500 as shown when used for measuring the load voltage. The probe assembly 500 is shown as probes 225 and 229 in FIG. 2. In FIG. 5, the probe assembly 500 has an insulating sleeve 501 which operates to hold a spring contact receptacle 503. When in use, a wire conductor (not shown) is connected to the contact receptacle 503 that passes through and exits the opposite end of the insulating sleeve 501. The wire conductor connects to a power electronics circuit (not shown) for monitoring load voltage. The contact receptacle 503 contains a conductive spring contact 505 that allows voltage measurement for different size loads and maintains contact during thermal expansions and contractions that occur during operation of the EF applications.

Thus, the transformer using an internal load offers many advantages over the prior art by reducing the size and complexity of a system when compared to conventional 50 Hz-60 Hz systems. In this particular application of an electrode furnace, the transformer using an internal load decreases overall weight, size, electromagnetic emissions, and circuit losses when compared to previous art. In view of the new transformer geometry and configuration, the secondary winding on the transformer and the associated flexible leads are eliminated as current is generated by magnetic coupling to the second conductor. The overall structure provides a closed or self shielded current path by using the canister structure to complete the electrical circuit for a brush contact, first conductor, load, and second conductor. Substantially low external electromagnetic fields are realized since the transformer and secondary circuit is shielded. The brush contact allows a movable high current contact that can slide inside the canister for providing adjustability in load size and thermal expansion. In addition, the brush contact allows separation of the first conductor from the second conductor assembly for electrode cleaning and installation or removal of a load. Another advantage of this architecture is the minimization of stray inductance due to the closed field structure and minimized current path lengths. Since secondary currents flow over the entire enclosure surface area, power losses are minimized. This creates a transformer assembly that can be driven by higher frequency switching supplies allowing for power factor correction and reduction in harmonic distortion when compared to prior art systems employing conduction angle or phase controlled chopper technologies.

Moreover, the present invention works to reduce the overall parts count over a conventional mounted power transformer by combining analytical functions of the first and second electrodes with the transformer construction. This eliminates the need for high current secondary windings, and eliminates flexible wire or strap connections between the transformer and the electrodes. Further, the present invention provides for lower power losses than can be obtained by a conventionally mounted transformer operating at frequencies utilized in switching power supply systems. Finally, lower primary winding losses in the transformer occur since all windings experience a similar magnetic field pattern due to the symmetrical shielding and current path provided by the canister structure. Thus, when used in combination with switching power supplies, the present invention provides a compact system that has superior performance over a conventional 50 Hz-60 Hz transformer design or a switching system using conventional connection means.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A transformer assembly for use with an internal load comprising:

a transformer core having a primary winding;

a first electrode for contacting the internal load;

a second electrode for contacting the internal load;

a secondary circuit comprising the first electrode, the second electrode, and at least one conductor positioned between the first electrode and second electrode; and an adjustable contact for allowing the load to be varied in size while remaining in contact with the first electrode and the second electrode; and wherein the at least one conductor surrounds the load, primary winding, transformer core, the first electrode and the second electrode.

2. A transformer assembly for use with an internal load as in claim 1, wherein the at least one conductor is a housing.

3. A transformer assembly for use with an internal load as in claim 2, wherein the housing is substantially cylindrical in shape.

4. A transformer assembly for use with an internal load as in claim 2, wherein the housing can be opened for replacing the load.

5. A transformer assembly for use with an internal load as in claim 4, wherein the housing can be opened at one end.

6. A transformer assembly for use with an internal load as in claim 1, wherein the load is positioned between the first electrode and the second electrode.

7. A transformer assembly for use with an internal load as in claim 1, wherein the at least one conductor engages a sliding contact for allowing a different size load to remain in contact with the first electrode and the second electrode.

8. A transformer assembly for use with an internal load as in claim 1, wherein a portion of the first electrode or the second electrode is positioned within the transformer core.

9. A transformer assembly for use with an internal load as in claim 1, further comprising at least one probe for measuring the voltage at the load.

10. A transformer assembly for use with an internal load as in claim 1, wherein the load is a crucible.

11. A transformer assembly for use with an internal load as in claim 1, wherein at least one of the first electrode or the second electrode includes a port.

12. A transformer assembly for use with an internal load as in claim 1, wherein the transformer assembly is used in an electrode furnace.

13. A transformer for supplying power to an internal load comprising:

a toroidal transformer core having a primary winding;

a first electrode for contacting an internal load within a conductive housing;

a second electrode for contacting the internal load within the conductive housing; and an adjustable contact for allowing a different size load to remain in contact with the first electrode and the second electrode; and wherein the first electrode, the second electrode, and the conductive housing form a secondary circuit for supplying power to the internal load positioned between the first electrode and the second electrode.

14. A transformer as in claim 13, wherein the conductive housing surrounds the toroidal transformer core, the first electrode and the second electrode.

15. A transformer as in claim 13, wherein the internal load is a crucible.

16. A transformer as in claim 15, wherein the crucible holds a sample material.

17. A transformer as in claim 13, wherein at least a portion of the first electrode or the second electrode are positioned within the toroidal transformer core.

18. A transformer as in claim 13, wherein the conductive housing is substantially cylindrical in shape.

19. A transformer as in claim 13, wherein the conductive housing can be opened for replacing the internal load.

20. A transformer as in claim 19, wherein the conductive housing can be opened at one end.

21. A transformer as in claim 13, further comprising at least one probe located in the conductive housing for measuring voltage of a load positioned within the conductive housing.

22. A transformer as in claim 13, wherein connections to the primary winding are provided at a side of the conductive housing.

23. A transformer as in claim 13, wherein the at least one electrode contains a port for collecting a gas from the load.

24. A transformer assembly as in claim 13, wherein a sliding contact engages at least one electrode.

25. A transformer as in claim 13, wherein the transformer is used in an electrode furnace.

26. A transformer assembly comprising:

at least one transformer core having a primary winding;

a conductor surrounding the at least one transformer core;

a plurality of electrodes positioned within the conductor for providing power to an internal load located within the conductor; and an adjustable contact for allowing the internal load to be varied in size; and wherein the conductor can be opened for replacing the internal load.

27. A transformer assembly as in claim 26, wherein the transformer is toroidal.

28. A transformer assembly as in claim 26, wherein the conductor can be opened from at least one end.

29. A transformer assembly as in claim 26, wherein the conductor includes a first conductor in contact with the internal load, a second conductor in contact with the internal load and a conductive housing.

30. A transformer assembly as in claim 28, wherein the conductive housing is substantially cylindrical.

31. A transformer assembly as in claim 26, wherein the plurality of electrodes include a first electrode and a second electrode.

32. A transformer assembly as in claim 26, wherein a portion of the plurality of electrodes extend through the at least one transformer core.

33. A transformer assembly as in claim 26, wherein the plurality of electrodes form a secondary circuit with the internal load.

34. A transformer assembly as in claim 26, wherein at least one of the plurality of electrodes includes a port for venting gas from the crucible.

35. A transformer assembly as in claim 26, wherein the internal load is a crucible.

36. A transformer assembly as in claim 26, further comprising at least one probe for measuring voltage at the internal load.

37. A transformer assembly as in claim 26, wherein the transformer assembly is used within an electrode furnace.

38. A transformer assembly for use in an electrode furnace comprising:

a conductive housing;

a transformer core having a primary winding positioned within the conductive housing;

a first conductor and a second conductor positioned within the conductive housing; and wherein the first conductor, second conductor and conductive housing form a secondary circuit with a crucible positioned within the conductive housing for acting as a load, and an adjustable contact for allowing the crucible to be varied in size while remaining in contact with the first electrode and the second electrode.

39. A transformer assembly for use in an electrode furnace as in claim 38, wherein the electrode furnace provides gaseous samples of materials placed in the crucible.

40. A transformer assembly for use in an electrode furnace as in claim 38, wherein the conductive housing is substantially cylindrical in shape.

41. A transformer assembly for use in an electrode furnace as in claim 38, wherein the conductive housing can be opened for replacing the crucible.

42. A transformer assembly for use in an electrode furnace as in claim 41, wherein the conductive housing is opened at least one end.

43. A transformer assembly for use in an electrode furnace as in claim 38, wherein the crucible is positioned between the first conductor and the second conductor.

44. A transformer assembly for use with an electrode furnace as in claim 38, further comprising at least one electrode for contacting the crucible.

45. A transformer assembly for use in an electrode furnace as in claim 38, further comprising a first electrode and a second electrode for contacting the crucible.

46. A transformer assembly for use in an electrode furnace as in claim 45, wherein a portion of the first electrode or the second electrode is positioned within the transformer core.

47. A transformer assembly for use in an electrode furnace as in claim 45, wherein the first electrode or the second electrode include a port for venting gas from the crucible.

48. A transformer assembly for use in an electrode furnace as in claim 38, further comprising at least one probe for measuring the voltage at the crucible.

49. A method of forming a transformer assembly for use with an internal load comprising the steps of:

forming a transformer core having a primary winding;

positioning a first electrode for contacting the load;

positioning a second electrode for contacting the load;

forming a secondary circuit comprising the first electrode, the second electrode, and at least one conductor;

positioning the at least one conductor between the first electrode and the second electrode; and utilizing an adjustable contact for allowing the load to be varied in size while remaining in contact with the first electrode and the second electrode; and arranging the at least one conductor such that it surrounds the load, primary winding, transformer core, the first electrode and the second electrode.

50. A method of forming a transformer assembly for use with an internal load as in claim 49, further comprising the step of:

using the at least one conductor as a housing.

51. A method of forming a transformer assembly for use with an internal load as in claim 50, further comprising the step of:

forming the housing into a substantially cylindrical shape.

52. A method of forming a transformer assembly for use with an internal load as in claim 49, further comprising the step of:

configuring the housing so that it can be opened.

53. A method of forming a transformer assembly for use with an internal load as in claim 52, further comprising the step of:

opening the housing at least one end.

54. A method of forming a transformer assembly for use with an internal load as in claim 49, further comprising the step of:

positioning the load between the first electrode and the second electrode.

55. A method of forming a transformer assembly for use with an internal load as in claim 49, further comprising the step of:

using the at least one conductor for engaging an adjustable contact for allowing a different size load to remain in contact with the first electrode and the second electrode.

56. A method of forming a transformer assembly for use with an internal load as in claim 49, further comprising the step of:

positioning a portion of the first electrode or the second electrode within the transformer core.

57. A method of forming a transformer assembly for use with an internal load as in claim 49, further comprising the step of:

using at least one probe for measuring the voltage at the load.

58. A method of forming a transformer assembly for use with an internal load as in claim 49, further comprising the step of:

using a crucible as the load.

59. A method of forming a transformer assembly for use with an internal load as in claim 49, further comprising the step of:

forming a port in the first electrode or the second electrode.

60. A method of forming a transformer assembly for use with an internal load as in claim 49, further comprising the step of:

using the transformer assembly in an electrode furnace.

* * * * *

UNITED STATES PATENT AND TRADEMARK OFFICE

CERTIFICATE OF CORRECTION

PATENT NO. : 8,299,879 B2
APPLICATION NO. : 13/024686
DATED : October 30, 2012
INVENTOR(S) : Casper et al.

It is certified that error appears in the above-identified patent and that said Letters Patent is hereby corrected as shown below:

Column 3, line 5, "invention" should be --invention.--;

Column 3, line 38, "proceeded" should be --preceded--;

Column 6, line 45, "in-turn" should be --in turn--;

Column 7, line 67, "is" should be --are--;

Column 8, lines 41-42, "of present" should be --of the present--;

Column 8, line 45, "as a critical" should be --as critical--;

Column 9, claim 17, line 52, "are" should be --is--;

Column 10, claim 31, line 27, "include" should be --includes--;

Column 10, claim 32, line 30, "extend" should be --extends--;

Column 11, claim 42, lines 2-3, "is opened at least one end" should be --is opened on at least one end--; and Column 12, claim 53, line 9, "opening the housing at least one end" should be --opening the housing on at least one end--.

Signed and Sealed this
Nineteenth Day of February, 2013

Teresa Stanek Rea

Teresa Stanek Rea
*Acting Director of the United States Patent and Trademark Office*